US007255228B2

(12) United States Patent
Kim

(10) Patent No.: US 7,255,228 B2
(45) Date of Patent: Aug. 14, 2007

(54) CELLULAR PHONE CASING WITH MELTED LIQUID FLOW DISCONNECTION HOLE ALONG HINGE LINE

(75) Inventor: Chang-Ho Kim, Incheon (KR)

(73) Assignee: Hana Cobi Co., Ltd., Seoul (KR)

( * ) Notice: Subject to any disclaimer, the term of this patent is extended or adjusted under 35 U.S.C. 154(b) by 188 days.

(21) Appl. No.: 10/992,337

(22) Filed: Nov. 19, 2004

(65) Prior Publication Data

US 2006/0021889 A1 Feb. 2, 2006

(30) Foreign Application Priority Data

Jul. 29, 2004 (KR) ..... 20-2004-0021605 U

(51) Int. Cl.
*B65D 85/00* (2006.01)
*B65D 45/16* (2006.01)
*B65D 51/04* (2006.01)

(52) U.S. Cl. ..... 206/320; 206/305; 220/315; 220/324; 220/840

(58) Field of Classification Search ..... 206/305, 206/320; 220/315, 324, 326, 833–840, 842; 224/424–435; 361/679, 683, 680–682
See application file for complete search history.

(56) References Cited

U.S. PATENT DOCUMENTS 2,687,157 A * 8/1954 Cowan ..... 220/315
2,732,581 A * 1/1956 Hech ..... 220/840
3,023,923 A * 3/1962 Geib et al. ..... 220/840
5,383,091 A * 1/1995 Snell ..... 361/679
5,752,615 A * 5/1998 Hofmann et al. ..... 220/324
5,938,063 A * 8/1999 Hoftman ..... 220/840
6,092,707 A * 7/2000 Bowes, Jr. ..... 224/435
6,129,237 A * 10/2000 Miyahara ..... 220/315
6,315,142 B1 * 11/2001 Kitamura et al. ..... 220/324
6,415,947 B1 * 7/2002 Kim ..... 220/326
6,456,487 B1 * 9/2002 Hetterick ..... 361/683
6,837,407 B1 * 1/2005 Towers et al. ..... 224/435
D517,311 S * 3/2006 Kim ..... D3/218
2005/0006390 A1 * 1/2005 Wang ..... 220/326

* cited by examiner

*Primary Examiner*—Bryon P. Gehman
(74) *Attorney, Agent, or Firm*—Birch, Stewart, Kolasch & Birch, LLP

(57) ABSTRACT

The present invention relates to an improved cellular phone casing capable of storing a cellular phone (a mobile phone) from an external impact when a cellular phone is stored in a bag and is carried and capable of preventing a cellular phone from moisture in rain or at a beach. The cellular phone storing casing comprises a casing body that has an inner storing space having a certain size and depth for storing a common cellular phone wherein an upper side of the same is opened for an easier storing and unloading of a cellular phone; a cover body that is fabricated in separation with the casing body and stores or unloads in a state that a cellular phone is sealed in the inner storing space of the casing body wherein the cover body is opened and closed with respect to the casing body; a hinge connection part that is designed so that the cover body is rotatable with respect to one surface of the casing body; and a locking part sealingly engages or opens the cover body with respect to the casing body.

9 Claims, 6 Drawing Sheets

CELLULAR PHONE CASING WITH MELTED LIQUID FLOW DISCONNECTION HOLE ALONG HINGE LINE

BACKGROUND OF THE INVENTION

1. Field of the Invention

The present invention relates to a cellular phone casing, and in particular to an improved cellular phone casing capable of storing a cellular phone (a mobile phone) from an external impact when a cellular phone is stored in a bag and is carried and capable of preventing a cellular phone from moisture in rain or at a beach.

2. Description of the Background Art

Generally, the size of a cellular phone is getting smaller and smaller for an easier carry. In addition, the weight of the same has been gradually decreased. For this reason, the casing of the cellular phone is generally made of a light plastic material. In this case, a LCD formed on a cover of a cellular phone is weak with respect to an external impact.

In addition, in a carrying method of a cellular phone, in the case of many people, since the size of a cellular phone is small, and it is easy to carry in hand, the cellular phone is carried in hands or a certain strap connected with a connection ring of a cellular phone body is hung on a user's neck. In another method, the cellular phone is generally stored in a bag or a handbag.

In addition, in the above cellular phone carrying method, in the case that the cellular phone is carried in hands, when a certain call comes in, a user can quickly pick up the cellular phone and can calls. However, in this case, there are many inconveniences to do another work with the remaining hand. Sometimes, the cellular phone may be dropped from hands, so that a big damage is given to the cellular phone.

As one example, in some cases, in a state that a user holds a cellular phone in his hand, when the user needs to use hands, the user may forget the state that he holds a cellular phone in his hands and then may drop the cellular phone for thereby damaging the cellular phone. When the cellular phone is dropped from the hands, the casing of the cellular phone may be seriously damaged by an external impact, and the LCD may be broken.

In addition, in the case that the neck strap is connected with the cellular phone and is hung on the user's neck, the cellular phone is not fixed, so that it may be swung. Namely, as the user walks, the cellular phone hung on the user's neck may be swung. When the user bends his upper body, the cellular phone hung on the user's neck may be downwardly extended and may hit the ground or the floor, so that the casing of the cellular phone may be damaged or the LCD may be broken.

When the cellular phone is stored in the handbag or the bag and is carried, the cellular phone may collide with other items stored in the handbag or bag, so that the casing of the cellular phone may be scratched or the LCD may be scratched. A certain metallic item may contact with the terminals of the battery, so that fire may occur.

In particular, when moisture penetrates into the electronic circuit, the cellular phone may become dead. Therefore, the users of the cellular phone should be careful about that water penetrates into the cellular phone. When it rains, the cellular phone cannot be held in hands. Namely, it should be stored in a safer place for thereby causing many inconveniences.

As described above, since the cellular phone is weak with respect to moisture and water, it is impossible to carry the cellular phone at beach. Therefore, the cellular phone cannot be carried during the swimming. In the case that a certain emergency occurs during the swimming, it is impossible to use the cellular phone. Therefore, in the conventional art, it is impossible to efficiently cope with the emergency situation.

In order to overcome the above problems, a certain cellular phone storing casing has been provided wherein it can be used at beach.

However, since the conventional cellular phone storing casing is made of a vinyl bag that does not have strength, and an input portion of the vinyl bag is designed in a structure that it is opened and closed by a synthetic resin zipper. Therefore, in the case of the cellular phone storing casing formed of a vinyl bag, it is possible to slightly prevent the penetration of water, however the vinyl bag cannot protect the cellular phone from an external impact. In addition, the opening operation of the synthetic resin zipper is easier, however the closing operation of the opened zipper is not easy for thereby causing many inconveniences. In the case that the user swims in a state that the closed state of the synthetic resin zipper is not checked, water may penetrate into the interior of the cellular phone storing casing, so that a critical problem may occur in the cellular phone due to the penetrated water.

SUMMARY OF THE INVENTION

Accordingly, it is an object of the present invention to provide a cellular phone storing casing capable of overcoming the problems encountered in the conventional art.

It is another object of the present invention to provide a cellular phone storing casing capable of protecting a cellular phone from a contact, friction or external impact.

It is further another object of the present invention to provide a cellular phone storing casing capable of protecting a cellular phone from moisture or water during rain or at beach.

It is still further another object of the present invention to provide a cellular phone storing casing capable of easily carrying a cellular phone in such a manner that a carrying assistant strap is connected with a casing that stores a cellular phone.

In order to achieve the above objects, there is provided a cellular phone storing casing, comprising a casing body that has an inner storing space having a certain size and depth for storing a common cellular phone wherein an upper side of the same is opened for an easier storing and unloading of a cellular phone; a cover body that is fabricated in separation with the casing body and stores or unloads in a state that a cellular phone is sealed in the inner storing space of the casing body wherein the cover body is opened and closed with respect to the casing body; a hinge connection part that is designed so that the cover body is rotatable with respect to one surface of the casing body; and a locking part that sealingly engages or opens the cover body with respect to the casing body.

The locking part includes a locking protrusion that is protruded from one surface of the casing body at a portion opposite to the hinge connection part; a locking wing that is integrally connected with the cover body and is folded and unfolded by the hinge line; and a locking hole that is formed at the locking wing wherein the locking protrusion is inserted and engaged therein.

The locking part includes a locking rim that is protruded from one surface of the casing body at a portion opposite to the hinge connection part in a straight line shape; a locking wing that is connected at the cover body opposite to the locking rim and is folded and unfolded by the hinge line; and an engaging protrusion that is engaged or separated from the lower side of the locking rim based on a rotation operation of the locking wing and is protruded from an inner side of the locking wing.

The locking wing is formed in a S-shape having a large curve, and the engaging protrusion is a protrusion curved and protruded from an inner side of the S-shape locking wing.

The locking part is formed on three surfaces except for the hinge connection part.

A connection ring is protruded at the hinge connection part, the cover body having the locking part at the opposite side or the casing body for connecting a portable assistant strap for an easier carriage.

A portable assistant strap is connected with the connecting ring in a closed shape.

The cover body includes inner and outer rims that form an engaging groove capable of receiving a rim of an upper side of the casing body along the outer side of the same, wherein a sealing packing is provided in the engaging groove formed between the inner and outer rims for thereby sealing the casing body and the cover body as it is elastically compressed by the upper side of the rim of the casing body when the cover body is closed.

The locking part is formed on three surfaces except for the surface in which the hinge connection part is formed, and the locking protrusions and locking holes are formed at the lowing wings having a longer length in multiple numbers, respectively, and a melted liquid flow disconnection hole is formed at the locking wings between the locking holes along the hinge line.

The hinge connection part includes a pin shaft that is selectively formed at the casing body and the cover body; and a hinge protrusion that is rotatable with respect to the pin shaft.

An impact prevention member is provided in the casing body.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
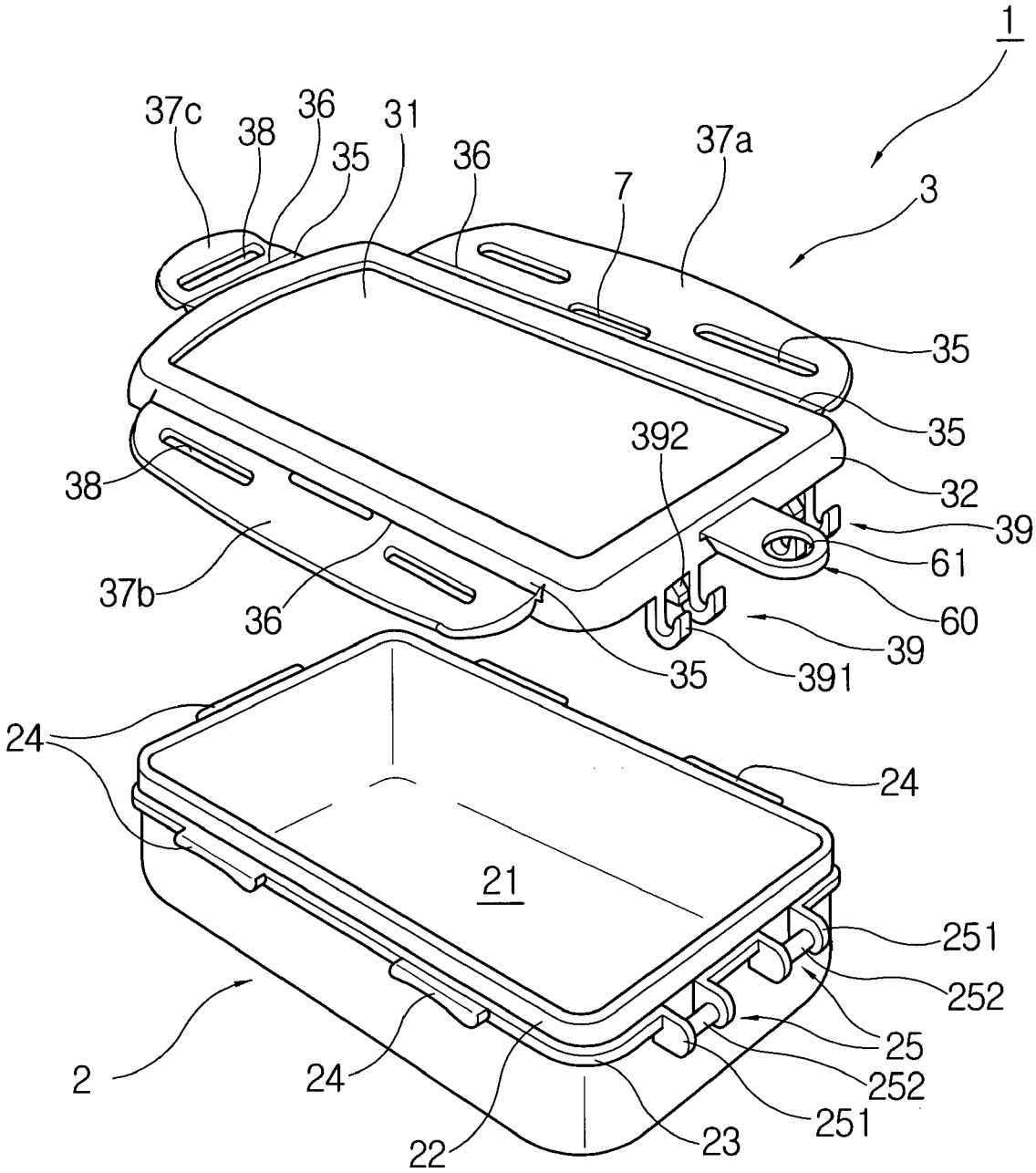
FIG. 1 is a perspective view illustrating a casing body and a cover body according to a first embodiment of the present invention.
Figure 2:
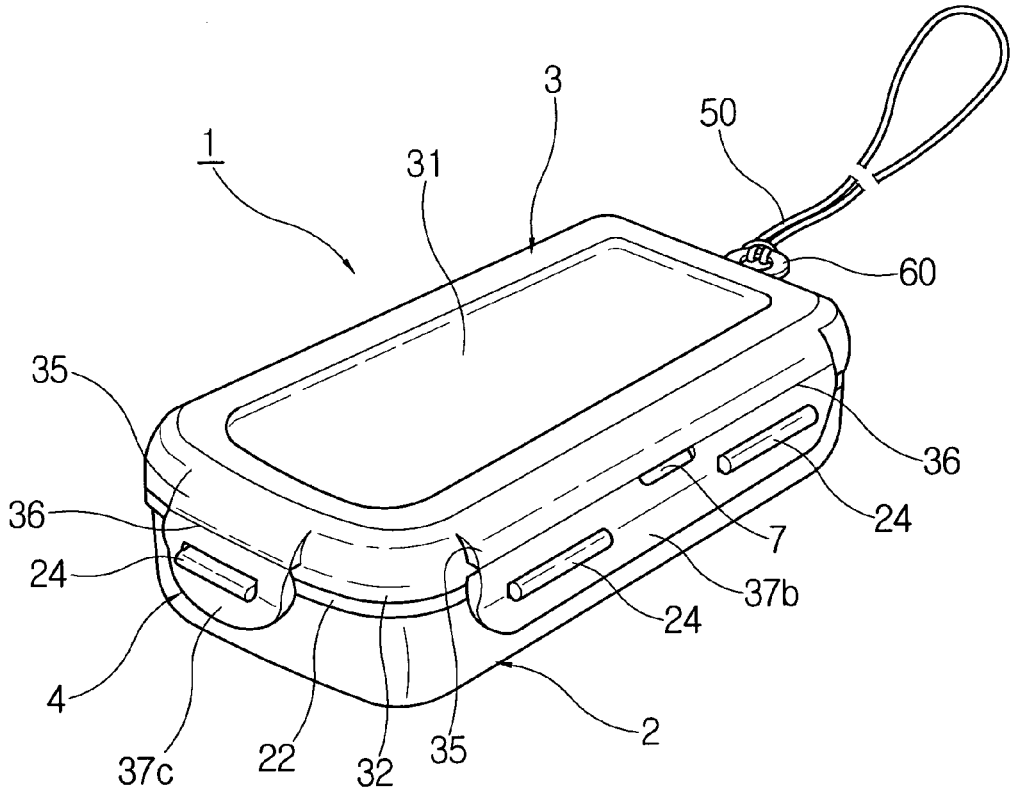
FIG. 2 is a perspective view illustrating a state of use according to a first embodiment of the present invention.
Figure 3:
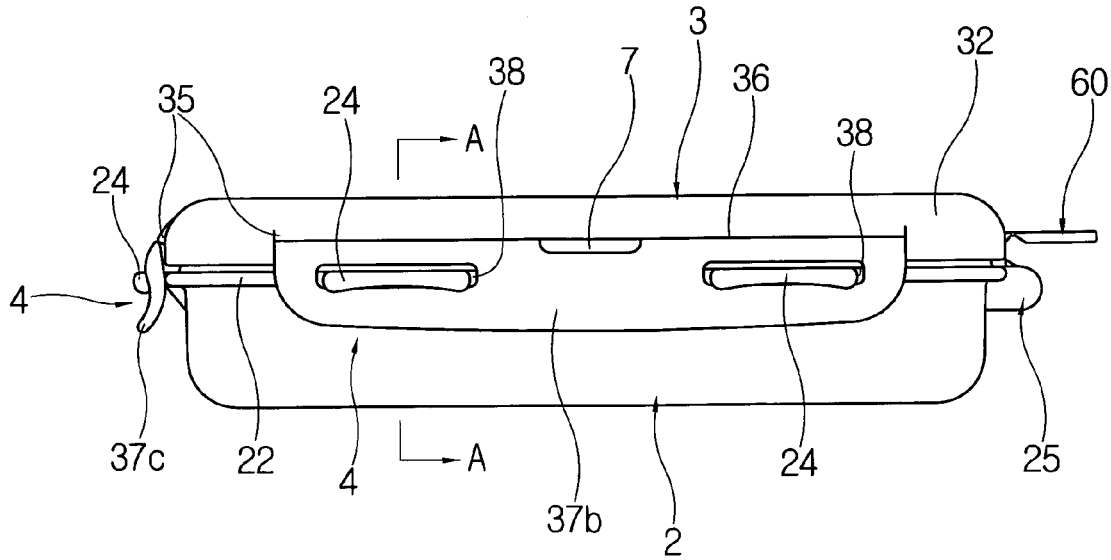
FIG. 3 is a front view illustrating a state of use according to a first embodiment of the present invention.
Figure 4:
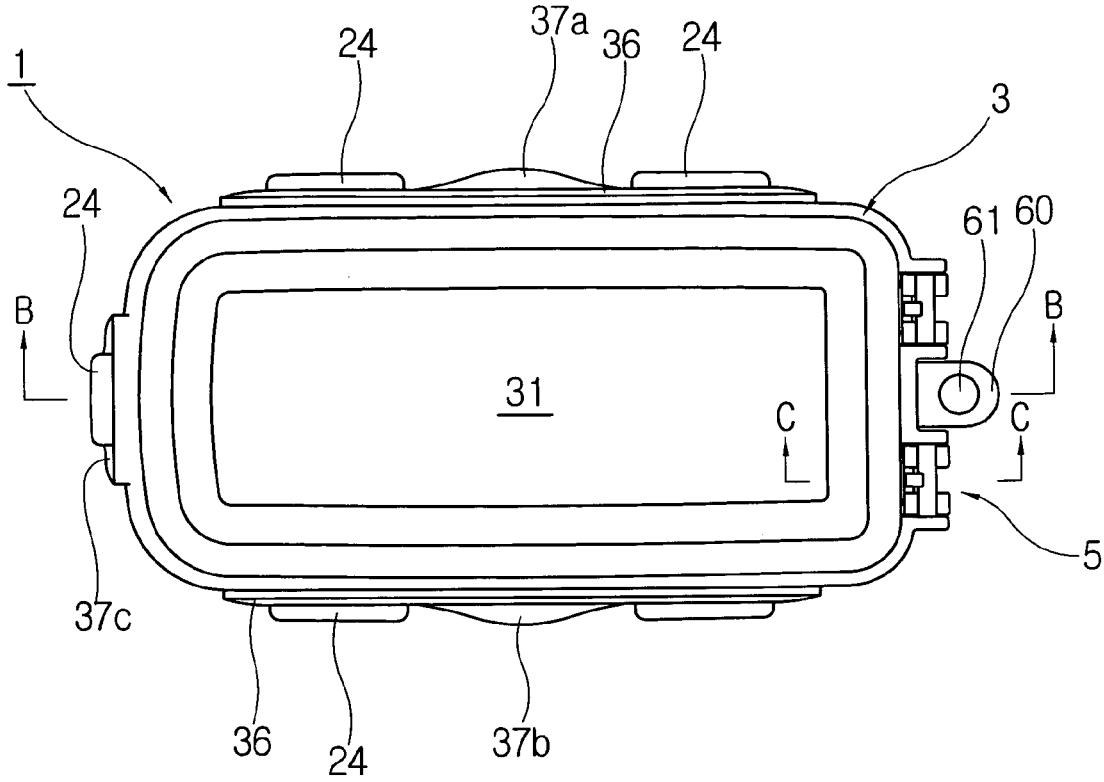
FIG. 4 is a plane view illustrating a state of use according to a first embodiment of the present invention.
Figure 5:
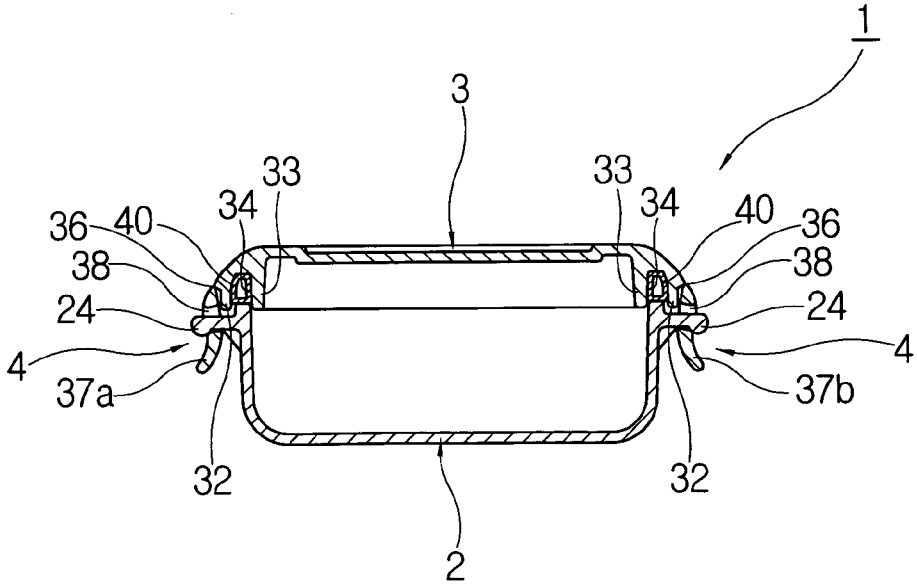
FIG. 5 is a cross sectional view taken along the line A-A of FIG. 3 according to the present invention.
Figure 6:
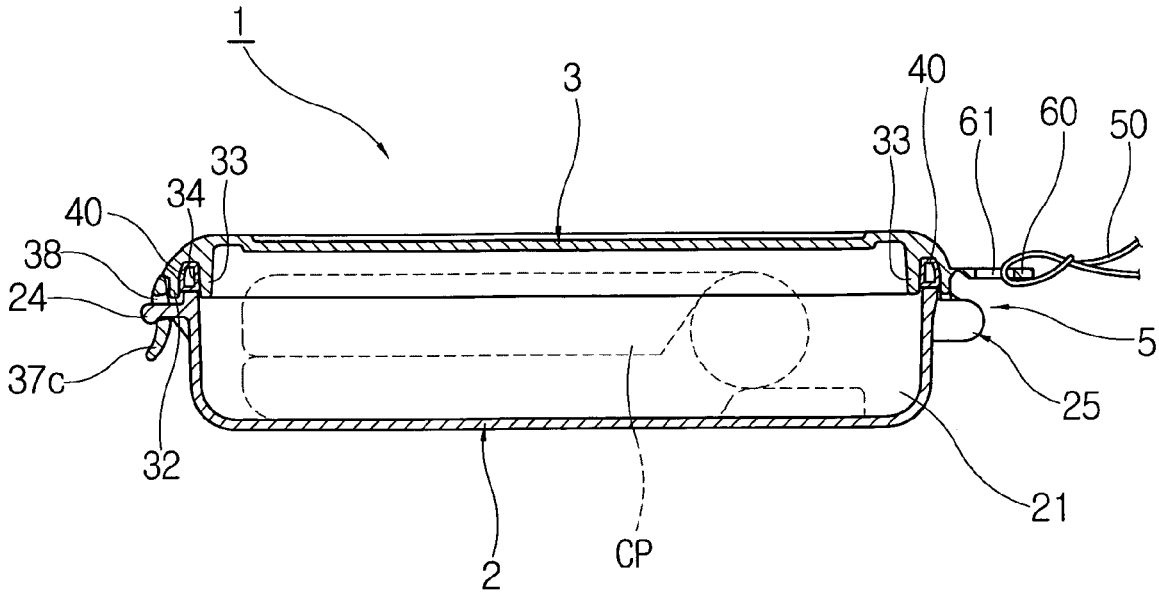
FIG. 6 is a cross sectional view taken along the line B-B of FIG. 4 according to the present invention.
Figure 7:
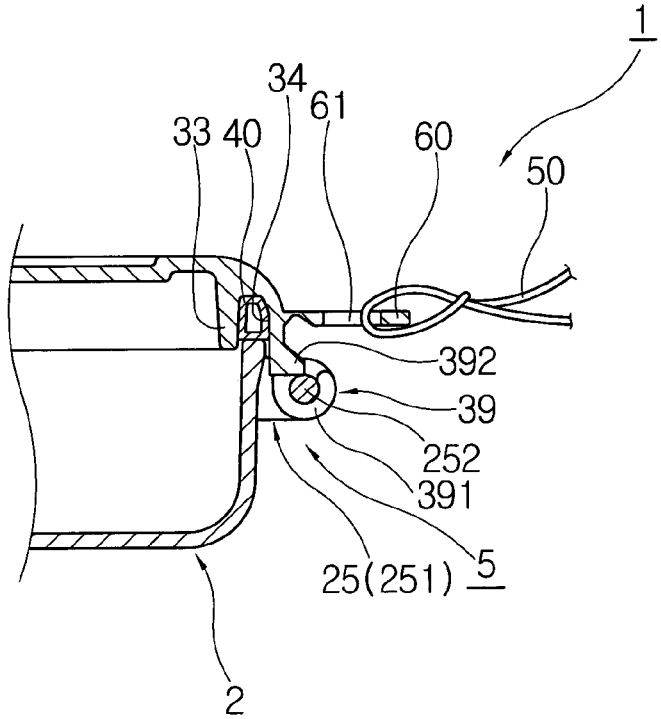
FIGS. 7 and 8 are cross sectional views taken along the line C-C of FIG. 4 for describing an opening and closing state of a cover body according to the present invention.
Figure 8:
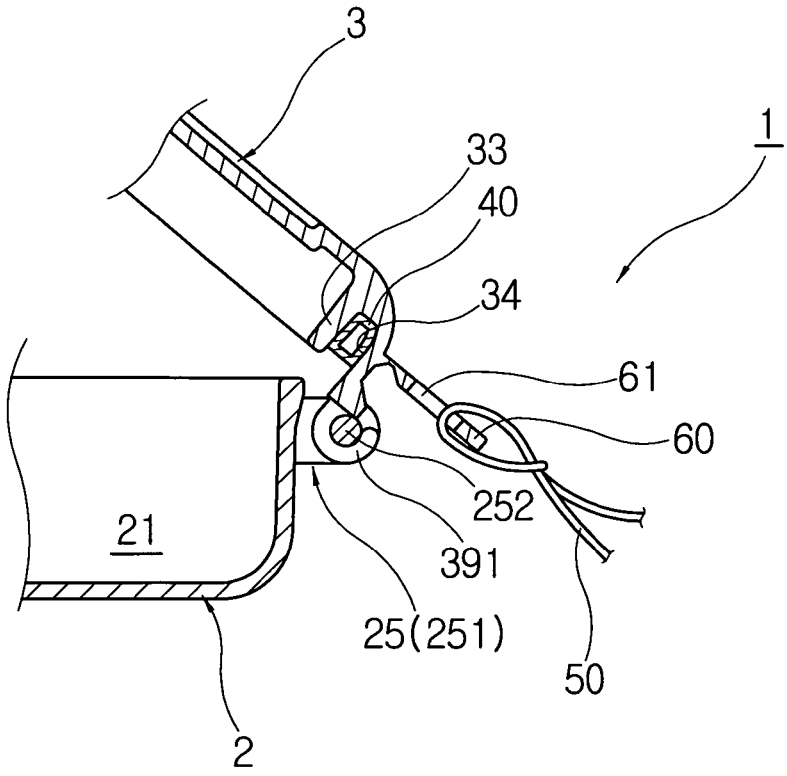

FIG. 1 is a perspective view illustrating a casing body and a cover body according to a first embodiment of the present invention, FIG. 2 is a perspective view illustrating a state of use according to a first embodiment of the present invention, FIG. 3 is a front view illustrating a state of use according to a first embodiment of the present invention, FIG. 4 is a plane view illustrating a state of use according to a first embodiment of the present invention, FIG. 5 is a cross sectional view taken along the line A-A of FIG. 3 according to the present invention, FIG. 6 is a cross sectional view taken along the line B-B of FIG. 4 according to the present invention, and FIGS. 7 and 8 are cross sectional views taken along the line C-C of FIG. 4 for describing an opening and closing state of a cover body according to the present invention.

In the drawings, reference numeral 1 represents a cellular phone storing case. The cellular phone storing casing 1 includes a casing body 2, a cover 3, a locking part 4 and a hinge connection part 5.

The construction of the casing body 2 will be described.

The casing body 2 is designed based on various cellular phones having different sizes and thickness. An inner storing space 21 is formed therein wherein an upper portion is opened. The inner storing space 21 has a certain size and depth for thereby storing the cellular phones (HP).

In the casing body 2, a protrusion rim 23 is formed below an opened rim upper portion 22. At least one locking protrusion 24 is protruded from the protrusion rim at each of three surfaces including one surface opposite to the hinge connection part. In the present invention, the cellular phone storing casing 1 is formed in a rectangular shape because almost cellular phones HP are formed in rectangular shapes. Therefore, a plurality of locking protrusions 24 are formed in the left and right longitudinal sides of the casing body 2. Preferably, two locking protrusions 24 are formed at each side. One locking protrusion 24 is protruded at one shorter side.

In addition, a plurality of fixed hinges 25 are formed in the shorter sides in which the locking protrusions 24 are not formed in the casing body 2. Each of the fixed hinges 25 is outwardly protruded from the protrusion rim 23 and includes a pair of opposite brackets 251, and a pin shaft 252 connecting the same.

The construction of the cover body 3 will be described.

The cover body 3 includes an upper surface 31 having a certain size capable of covering the opened upper side of the casing body 2, an outer rim 32 that is bent in the direction of the casing body 2 from the edges of the upper surface and is designed to cover the outer sides of the rim upper side 22 of the casing body, an inner rim 33 that is formed in an inner side of the outer rim for thereby surrounding the inner side of the rim upper side 22, an engaging groove 34 formed between the inner and outer rims 32 and 33 for allowing the rim upper side 22 to be inserted, so that the cover body 3 is sealingly engaged with the upper side of the casing body 2.

In addition, the hinge part 35 is formed at the portion opposite to the locking protrusion 24 in the four sides of the outer rim 32 at the outer side of the cover body 3. Locking wings 37*a*, 37*b* and 37*c* are connected at the hinge portions 35 in such a manner that the locking wings 37*a*, 37*b* and 37*c* are freely folded and unfolded with respect to the hinge line 36. A locking hole 38 is formed at each locking wing wherein the locking holes 38 are detachably engaged with the locking protrusions 24 formed at each of three surfaces of the casing body 2. The number of the locking holes 38 is determined based on the number of the locking protrusions 24. In the present invention, two locking holes 38 are formed at two locking wings 37*a* and 37*b* that are longitudinally formed. One locking hole is formed at one shorter locking wing 37*c*.

In addition, a plurality of driving hinges 39 are downwardly extended from the edge portions of the outer rim in one surface in which the locking wings are not formed as one side of the outer rim 32 of the cover body 3. In each driving hinge 39, at least one hinge protrusion 391 is downwardly extended and is curved in such a manner that an end of the same forms a circle in the upward direction for thereby forming a J-shape. Preferably, the hinge protrusion 391 is formed at the center or at both sides of the same. The hinge protrusions 391 that form the driving hinges are inserted between the brackets 251 that are opposite between the fixed hinges 25 formed at the casing body 2 and are rotatable with respect to the pin shaft 252. In addition, a support protrusion 392 is protruded between hinge protrusions 391 that form a plurality of driving hinges 39 for thereby supporting the upper side of the pin shaft 252. Therefore, when each driving hinge 39 is assembled to each fixed hinge 25, the hinge protrusions 391 surround the lower side of the pin shaft 252 and are assembled, and the support protrusions 392 rotatably support the upper side of the pin shaft 252. Therefore, the driving hinge 39 is not loosened from the fixed hinge 25 when the cover body 3 is opened and closed.

In addition, a sealing packing 40 is inserted into the engaging groove 34 formed between the inner and outer rims 33 and 32 of the cover body 3 in order for the cover body 3 to seal the casing body 2. The sealing packing 40 is formed of a rubber material and has a fully filled cross section. In another embodiment of the present invention, it may have a hollow cross section. The sealing packing 40 has a better elasticity for thereby enhancing a sealing force of the cover body 3. The sealing packing 40 having a hollow cross section is preferably used in order to protect the cellular phone from moisture or water.

In the cellular phone storing casing 1, a portable assistant strap 50 may be connected in a circular shape like a strap connected with the cellular phone thereby for achieving an easier carriage. In the present invention, a connection ring 60 having a connection hole 61 capable of connecting the portable assistant strap 50 is formed at one surface of the outer rim 32 in which the locking wings 37*a*, 37*b* and 37*c* are not formed in the cover body 3. At this time, the connection ring 60 may be formed at either the cover body or the casing body of the surface in which the hinge connection part 5 is positioned or the opposite locking part is formed.

A melted liquid flow disconnection hole 7 is formed along the hinge line 36 at the center between two locking holes 38 in order to prevent a welded line from being formed at the hinge line 36 that connects both locking wings 37*a* and 37*b* formed at the left and right sides in which the lengths of the outer rim 32 are longer when the injection is performed. The melted liquid flow disconnection hole 7 operates in such a manner that the melted liquid spreading in all directions when the plastic melted liquid is injected in the direction of the center of the upper surface 31 of the cover body 3 is not gathered at one portion but meets with the bodies of the locking wings 37*a* and 37*b*. Therefore, the life span of each locking wing 36 is significantly extended since the welded line is not formed at the hinge line 36 based on the melted liquid flow disconnection hole 7.

The operation of the present invention will be described with reference to the accompanying drawings.

The sealing engaged state by the locking part 4 should be released in order to uncover the cover body 3 engaged to the casing body 2. When each locking wing 37*a*, 37*b* and 37*c* formed at three surfaces of the cover body 3 is released from each locking protrusion 24, only the driving hinge 39 formed at one side of the outer rim 32 is rotatable with respect to the fixed hinge 25 of the casing body 2 in the cover body 3 as shown in FIGS. 7 and 8.

Therefore, the user opens the cover body 3 (at this time, the cover body is rotated by the hinge connection parts 5 (25, 39)) and is tilted in one side and opened), so that the user can store the cellular phone in the inner storing space 21 of the casing body 2. After the cellular phone is stored, the cover body 3 is closed, and each locking wing 37*a*, 37*b* and 37*c* is rotated in the direction of the casing body 2, and the locking protrusion 24 is inserted into the locking hole 38 formed at the locking wing. In this state, the cover body 3 fully covers the upper side of the casing body 2. At this time, the sealing packing 40 disposed between the inner and outer rims 33 and 32 elastically compresses the rim upper side 22 of the casing body 2 by the engaging force of each locking wing. The above sealing state is continuously maintained until each locking wing 37*a*, 37*b* and 37*c* is released from the locking protrusion 24 of the casing body 2.

Figure 9:
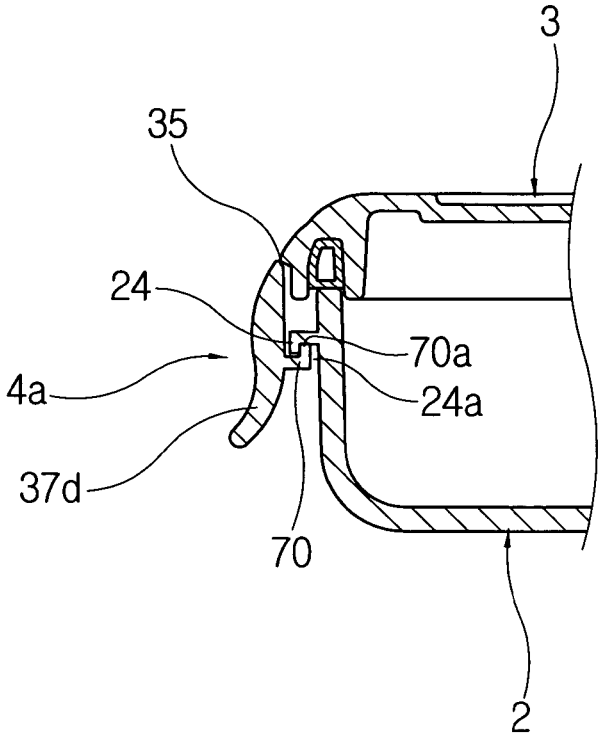
FIG. 9 is a front cross sectional view according to a second embodiment of the present invention.

FIG. 9 is a view of the second embodiment of the present invention. As shown therein, the construction of the locking part 4*a* is different from the first embodiment of the present invention. An engaging groove 24*a* is formed at the lower side of the locking rim 24 protruded along the outer portion of the upper side of the casing body 2, and the engaging protrusion 70 is protruded at the inner side of the locking wing 37*d* connected with the cover body 3 with the hinge line 35. In the above state, when the locking wing 37 is pressed closer to the locking rim 24, the end 70*a* of the engaging protrusion 70 moves over the lower surface of the locking rim 24 and is engaged to the engaging groove 24*a*, so that the cover body 3 is sealingly engaged with the casing body 2.

Therefore, the engaging protrusion 70 is formed in a L-shape in which the end 70*a* is upwardly protruded in a horizontal state.

Figure 10:
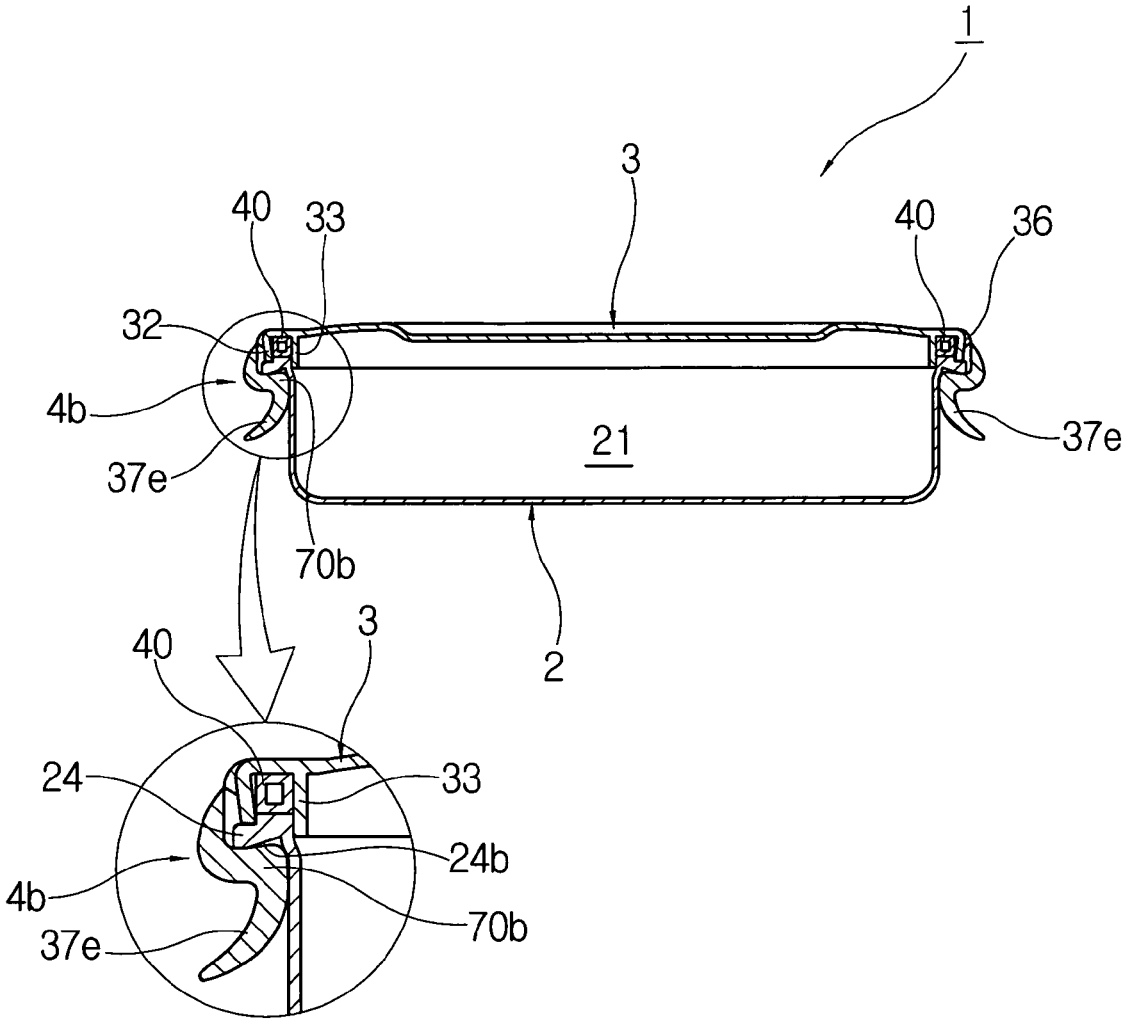
FIG. 10 is a front cross sectional view according to a third embodiment of the present invention.

FIG. 10 is a view of the third embodiment that the second embodiment of the present invention is modified. In this embodiment of the present invention, the locking wing 37*e* forming the locking part 4*b* is formed in a S-shape having a larger curve. The protrusion portion 70*b* protruded and curved in the inner direction of the locking wing 37*e* performs the operation like the engaging protrusion 70 of the first embodiment.

The protrusion portion 70*b* corresponding to the engaging protrusion 70 has a slanted surface that is almost horizontal or slightly rises in the inner direction in its upper surface in a state that the locking wing 37*e* is locked, or an end portion of the same slightly rises in the upward direction. The protrusion portion 70*b* is caught by the lower surface 24*b* concaved in the locking rim 24 formed at the casing body 2.

The locking rim 24 is formed of a slanted surface or an upwardly concaved grove, so that the lower surface 24*b* can receive the upper end of the protrusion 70*b*.

In the case of the second embodiment of the present invention, when injecting the cover body 3, an assistant core should be used due to the engaging protrusion 70. In the case of the third embodiment of the present invention, since the locking wing 37*e* is formed in a S-shape and the inner portion of the body shares the function of the engaging protrusion, it is possible to fabricate without using the assistant core during the injection.

In the present invention, in a state that the cellular phone HP is stored in the cellular phone storing casing 1 of which the cover body 3 is engaged to the casing body 2, even when the cellular phone storing casing 1 is exposed to rain water while hanging the cellular phone on the neck using the portable assistant strap 50, the rain water is not penetrated into the inner storing space 21 of the casing body 2. In addition, even when the cellular phone gets wet in water at beach, it does not sink, so that water does not penetrate, and it is possible to protect the cellular phone stored in the cellular phone storing casing 1 from moisture and water.

In addition, since the cellular phone HP stored in the cellular phone storing casing 1 is protected by the casing body 2 and the cover body 3, when carrying the cellular phone in a state that the cellular phone is stored in the bag, the other items stored in the bag contact with the cellular phone storing casing 1 with no friction. Even when the cellular phone casing 1 is dropped on the floor or the ground, it is possible to absorb the impact for thereby effectively protecting the cellular phone HP. In addition, the cellular phone storing casing 1 may include a certain impact prevention material such as sponge, foamed resin, or foamed packing paper for thereby effectively absorbing and decreasing the impact. In another embodiment of the present invention, an impact prevention material may cover and store the cellular phone, so that it is possible to more effectively protect the cellular phone HP.

As described above, in the present invention, when various kinds of cellular phones used by many people are stored in the cellular phone storing casing according to the present invention, it is possible to easily hear the incoming signals of the cellular phone. In the manner mode, it is possible to easily recognize the vibration sound or vibration, so that there is not any problem in the use of cellular phone. Even when the user drops the cellular phone storing casing onto the floor or the ground, it is possible to safely protect the cellular phone. In addition, even when the cellular phone casing is exposed in rain, rainwater does not penetrate into the interior having the cellular phone therein. If the cellular phone storing casing is dropped into water, the interior of the same is fully sealed for thereby preventing the penetration of water thereinto. Therefore, in the present invention, it is possible to safely store the cellular phone in the cellular phone storing casing, so that a n emergency call may be made at the outdoor or at beach. When an emergency situation occurs, it is possible to send a rescue call using the cellular phone.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A cellular phone storing casing, comprising:

a casing body having an inner storing space having a certain size and depth for storing a cellular phone, an upper side of the casing body being open for storing and unloading of the cellular phone;

a cover body separate from the casing body for covering the casing body so that the cellular phone is sealed in the inner storing space of the casing body, wherein the cover body is opened and closed with respect to the casing body;

a hinge connection part operatively connecting the cover body to the casing body so that the cover body is readily attachable and detachable from the casing body and rotatable with respect to one surface of the casing body; and locking means for sealingly locking and unlocking the cover body with respect to the casing body, wherein said locking means includes:

a locking protrusion that is protruded from one surface of the casing body at a portion opposite to the hinge connection part;

a locking wing that is integrally connected with the cover body and is folded and unfolded by a hinge line; and a locking hole that is formed at the locking wing wherein the locking protrusion is inserted and engaged therein, wherein said locking protrusions and locking holes are formed at the locking wings having a longer length in multiple numbers, respectively, and a melted liquid flow disconnection hole is formed at the locking wings between the locking holes along the hinge line.

2. The casing of claim 1, wherein said locking means includes:

a locking rim that is protruded from one surface of the casing body at a portion opposite to the hinge connection part in a straight line shape;

a locking wing that is connected at the cover body opposite to the locking rim and is folded and unfolded by a hinge line; and an engaging protrusion that is engaged or separated from the lower side of the locking rim based on a rotation operation of the locking wing and is protruded from an inner side of the locking wing.

3. The casing of claim 2, wherein said locking wing is formed in an S-shape having a large curve, and said engaging protrusion is a protrusion curved and protruded from an inner side of the S-shape locking wing.

4. The casing of claim 1, wherein a connection ring is protruded at the hinge connection part, the cover body having the locking means at the opposite side of the casing body for connecting a portable assistant strap for an easier carriage.

5. The casing of claim 4, wherein a portable assistant strap is connected with the connecting ring in a closed shape.

6. The casing of claim 1, wherein said cover body includes:

inner and outer rims that form an engaging groove capable of receiving a rim of an upper side of the casing body along the outer side of the same, wherein a sealing packing is provided in the engaging groove formed between the inner and outer rims for thereby sealing the casing body and the cover body as it is elastically compressed by the upper side of the rim of the casing body when the cover body is closed.

7. The casing of claim 1, wherein said hinge connection part includes:

a pin shaft that is selectively formed at the casing body and the cover body; and a hinge protrusion that is rotatable with respect to the pin shaft.

8. The casing of claim 1, wherein an impact prevention member is provided in the casing body.

9. A cellular phone storing casing, comprising:

a casing body that has an inner storing space having a certain size and depth for storing a common cellular phone wherein an upper side of the same is opened for an easier storing and unloading of a cellular phone;

a cover body that is fabricated in separation with the casing body and stores or unloads in a state that a cellular phone is sealed in the inner storing space of the casing body wherein the cover body is opened and closed with respect to the casing body;

a hinge connection part that is designed so that the cover body is rotatable with respect to one surface of the casing body; and a locking means that sealingly engages or opens the cover body with respect to the casing body; wherein the locking means includes:

a locking protrusion that is protruded from one surface of the casing body at a portion opposite to the hinge connection part;

a locking wing that is integrally connected with the cover body and is folded and unfolded by the hinge line; and a locking hole that is formed at the locking wing wherein the locking protrusion is inserted and engaged therein; and wherein said locking protrusions and locking holes are formed at the locking wings having a longer length in multiple numbers, respectively, and a melted liquid flow disconnection hole is formed at the locking wings between the locking holes along the hinge line.

* * * * *